US009099260B2

(12) United States Patent
Boffelli et al.

(10) Patent No.: US 9,099,260 B2
(45) Date of Patent: Aug. 4, 2015

(54) SWITCHING DEVICE AND RELATED SWITCHGEAR

(75) Inventors: Carlo Boffelli, Dalmine (IT); Roberto Penzo, Milan (IT)

(73) Assignee: ABB TECHNOLOGY AG, Zurich (CH)

( * ) Notice: Subject to any disclaimer, the term of this patent is extended or adjusted under 35 U.S.C. 154(b) by 490 days.

(21) Appl. No.: 13/466,496

(22) Filed: May 8, 2012

(65) Prior Publication Data

US 2012/0285806 A1 Nov. 15, 2012

(30) Foreign Application Priority Data

May 10, 2011 (EP) ..... 11165428

(51) Int. Cl.
*H01H 9/38* (2006.01)
*H01H 9/54* (2006.01)
*H01H 9/56* (2006.01)

(52) U.S. Cl.
CPC *H01H 9/542* (2013.01); *H01H 9/56* (2013.01)

(58) Field of Classification Search
CPC . H01H 9/541; H01H 9/542; H01H 2009/544; H01H 2009/546
USPC ..... 218/10, 11, 13; 439/88, 181, 184–187, 439/934; 200/504
See application file for complete search history.

(56) References Cited

U.S. PATENT DOCUMENTS 3,636,292 A 1/1972 Roth
4,393,291 A * 7/1983 Stewart et al. ..... 218/51
7,148,441 B2 * 12/2006 Daharsh et al. ..... 218/136

FOREIGN PATENT DOCUMENTS

DE 10064525 A1 6/2002
GB 819717 9/1959
JP 61-260516 A 11/1986
JP 3-129614 A 6/1991
WO WO 01/37300 A1 5/2001

OTHER PUBLICATIONS

European Search Report issued on Nov. 12, 2011, for European Application No. 11165428.1.

* cited by examiner

*Primary Examiner* — Felix O Figueroa
(74) *Attorney, Agent, or Firm* — Buchanan Ingersoll & Rooney PC

(57) ABSTRACT

An exemplary switching device connects and disconnects a power line to and from, respectively, at least an associated electrical load. The switching device includes at least one phase of the switching device having a housing that includes a movable contact configured to be coupled to and separated from a corresponding fixed contact, wherein the at least one phase of the switching device includes an electrically semi-conducting assembly having an insulating support operatively associated with a plurality of semiconductor devices, wherein the plurality of semiconductor devices are connected in series and are electrically connected to said fixed contact and to said movable contact, and wherein the semiconducting assembly is configured to be installed into the housing to surround at least a portion of at least one of said fixed contact the movable contact when it is coupled to the fixed contact.

18 Claims, 10 Drawing Sheets

SWITCHING DEVICE AND RELATED SWITCHGEAR

RELATED APPLICATION

This application claims priority under 35 U.S.C. §119 to European Patent Application No. 11165428.1 filed in Europe on May 10, 2011, the entire content of which is hereby incorporated by reference in its entirety.

FIELD

The present disclosure relates to a switching device for connecting/disconnecting an electrical line to/from at least an associated electrical load, and to a switchgear including such a switching device.

BACKGROUND INFORMATION

Switching devices are installed in electrical circuits for connecting/disconnecting a power line to/from one or more associated electrical loads.

Known switching devices can include at least a phase, or pole, with a movable contact which is movable between a first connected position, in which it is coupled to a corresponding fixed contact (closed switching device), and a second separated position, in which it is separated from the fixed contact (open switching device). For example, if the electric load is formed by a bank of capacitors, a switching device is provided for operatively associating an AC medium voltage line to the bank of capacitors. By opening or closing the switching device, reactive power is added or removed to/from the power line.

Each phase of the switching device is electrically connected to a power line and the associated electrical load, in such a way that a current can flow between the power line and the load through the main conducting path provided by the coupled fixed and movable contacts. The flowing current is interrupted by the separation of the movable contacts from the corresponding fixed contacts, for example in case of faults.

In these known solutions, each phase of the switching device can be provided with a large number of semiconductor devices which are electrically connected in series to each other and are suitable for blocking current flowing therethrough in a blocking direction and for conducting current flowing therethrough in an allowed direction.

The overall semiconductor devices of a phase can be electrically connected in parallel to the main current path provided by the coupled movable contact and the fixed contact. The large number of semiconductor devices is due to the fact that each semiconductor device cannot withstand a tension value above a certain limit operation value, for example, at about 1 kV for standard devices.

Synchronizing the movement of the movable contact to the waveform of the alternate current flowing through the phase of the switching device, the conductive path provided by the semiconductor devices can be used for the flowing current, avoiding or at least reducing the generation of electrical arcs during the opening operation of the switching device (when the line is disconnected from a load, e.g. a bank of capacitors), and limiting an inrush current and transient voltages generated during the closing operation (when the line is coupled to the load, e.g. the bank of capacitors).

At the current state of the art, although known solutions perform satisfactorily there is still a desire for further improvements, in particular with regard to the constructive layout of the semiconducting devices and their positioning relative to the remaining parts of the switching device to which they are associated.

SUMMARY

A switching device for connecting and disconnecting a power line to and from, respectively, at least an associated electrical load is disclosed. The switching device comprising: at least one phase of the switching device having a housing that includes a movable contact configured to be coupled to and separated from a corresponding fixed contact, wherein the at least one phase of the switching device comprises: an electrically semiconducting assembly having an insulating support operatively associated with a plurality of semiconductor devices, wherein said plurality of semiconductor devices are connected in series and are electrically connected to said fixed contact and to said movable contact, and wherein said semiconducting assembly is configured to be installed into said housing to surround at least a portion of at least one of said fixed contact and said movable contact when it is coupled to the fixed contact.

BRIEF DESCRIPTION OF THE DRAWINGS

Further characteristics and advantages will be more apparent from the description of exemplary, but non-exclusive, embodiments of the switching device according to the present disclosure, illustrated in the accompanying drawings, wherein.

DETAILED DESCRIPTION

Exemplary embodiments of the present disclosure include a switching device for connecting/disconnecting a power line to/from at least an associated electrical load, including at least a phase having a housing which houses a movable contact couplable/separable to/from a corresponding fixed contact. The phase includes an electrically semiconducting assembly having an insulating support operatively associated with a plurality of semiconductor devices electrically connected in series to each other, the plurality of semiconductor devices being associated and electrically connected to said fixed contact and to said movable contact, wherein the assembly is configured to be installed into the housing so as to surround at least a portion of at least one of the fixed contact and the movable contact when it is coupled to the fixed contact.

In the context of the present disclosure, exemplary embodiments will be described by making particular reference to applications connecting/disconnecting an AC medium voltage line to/from a bank of capacitors, in lower and higher ranges of operating voltages, and/or for different purposes. It is to be set forth that the term "medium voltage" used in the present disclosure refers to electrical applications with nominal voltages from 1 kV up to some tens of kV, e.g. 52 kV.

For example, exemplary switching devices according to the present disclosure may be conceived as a hybrid circuit breaker for disconnecting a power line from the associated electrical load, upon the occurrence of electric faults in the circuit, such as a short-circuit fault.

Figure 1:
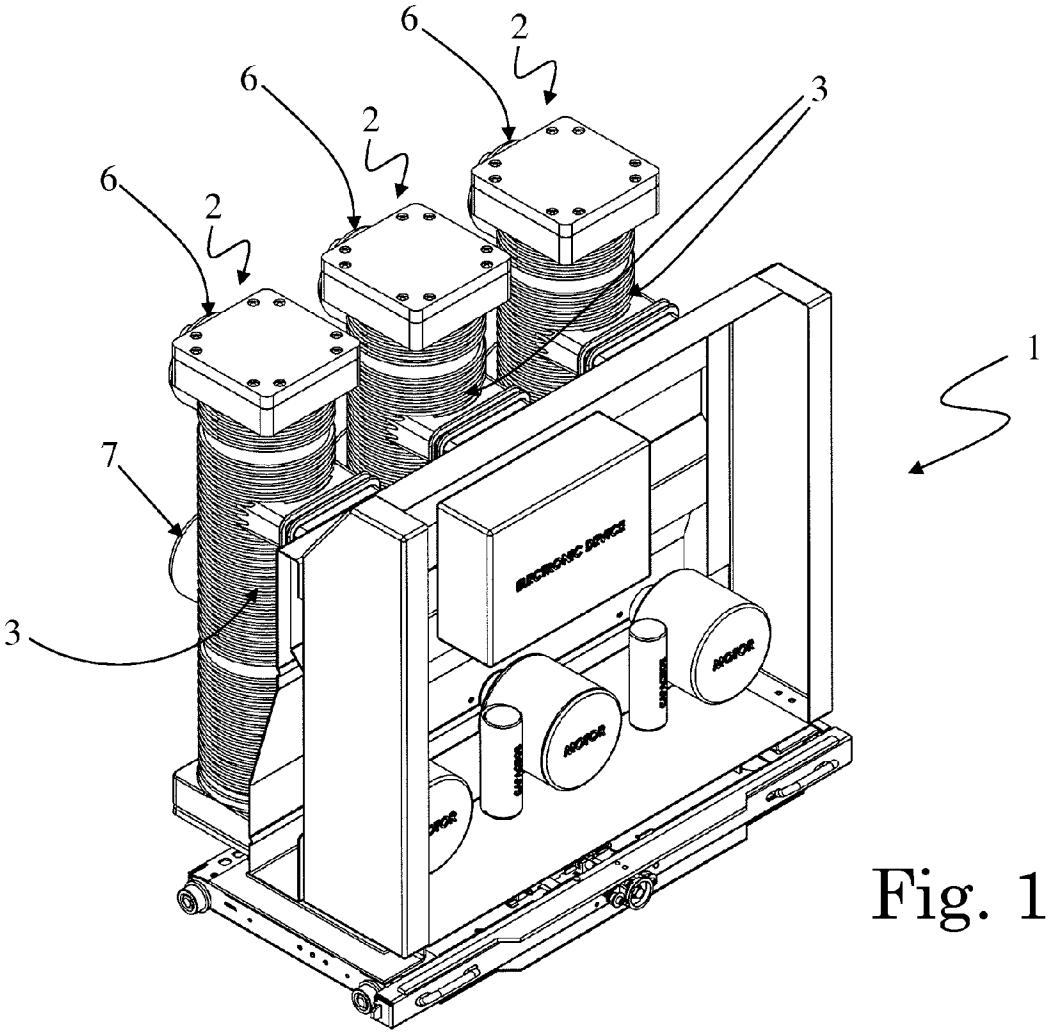
FIG. 1 is a perspective view of a switching device in accordance with an exemplary embodiment.

FIG. 1 is a perspective view of a switching device in accordance with an exemplary embodiment. FIG. 1 illustrates an exemplary embodiment of a multi-phase switching device 1 according to the present disclosure, which is suitable for connecting/disconnecting a power line, for example an AC medium voltage line, to/from at least an associated electrical load. For the sake of simplicity, in the following description reference will be made just to one phase 2 of the switching device 1; however, it is to be understood that what follows is applicable to all the phases 2 of the switching device 1 according to the present disclosure.

The switching device 1 illustrated in FIG. 1 includes for example three phases 2, or poles 2, each of which is electrically connected to a corresponding phase of the power line and to an associated electrical load. The number of phases 2 may be different to the illustrated one, according to specifications of the individual applications for the switching device 1.

Figure 2:
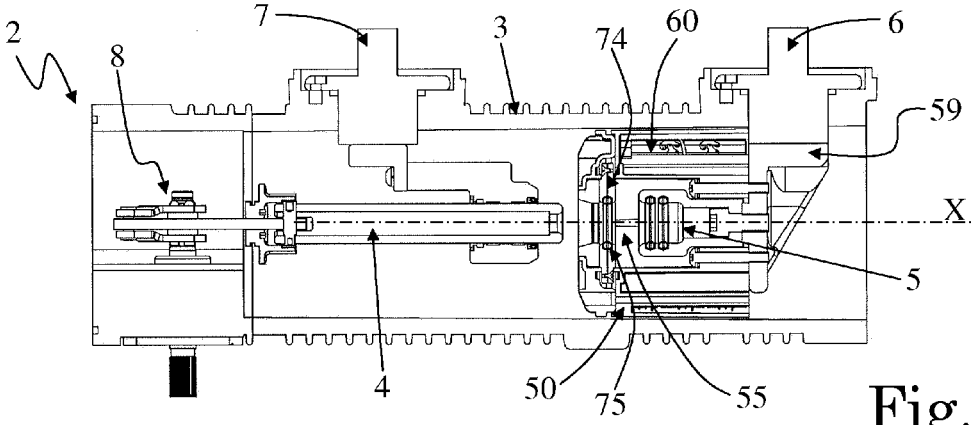
FIGS. 2-4 are sectional views showing the inner part of a housing of the switching device in FIG. 1, each at a different position of the movable contact in accordance with an exemplary embodiment.
Figure 3:
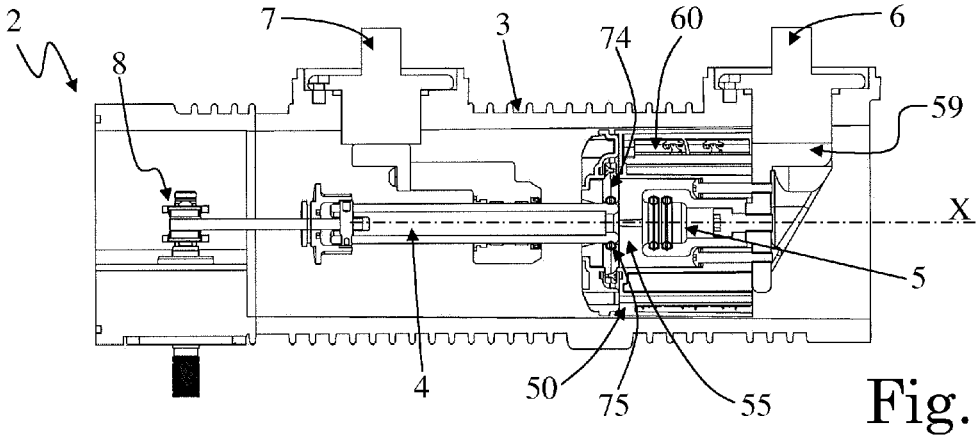
Figure 4:
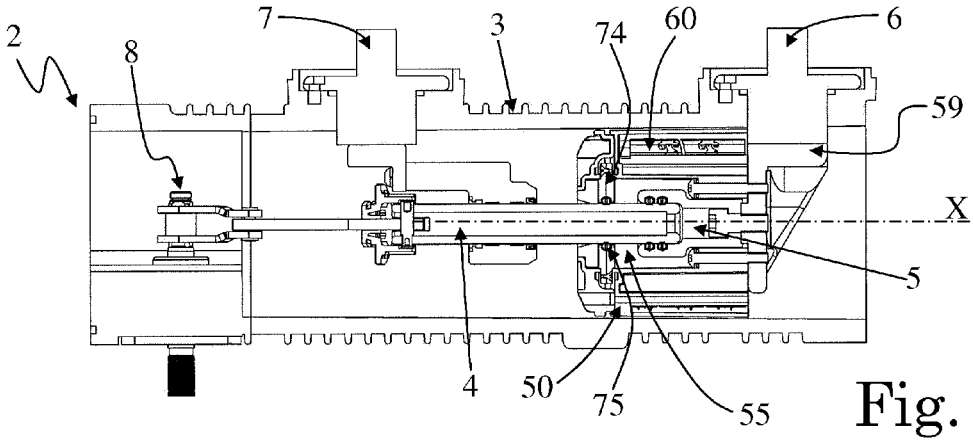

Each phase 2 includes a movable contact 4 couplable/separable to/from a corresponding fixed contact 5 (see FIGS. 2-4). The fixed contact 5 and the movable contact 4 are electrically connected to a first terminal 6 and a second terminal 7, respectively, which are suitable for connecting the phase 2 to the corresponding phase of the power line and of the associated electrical load.

Figure 9:
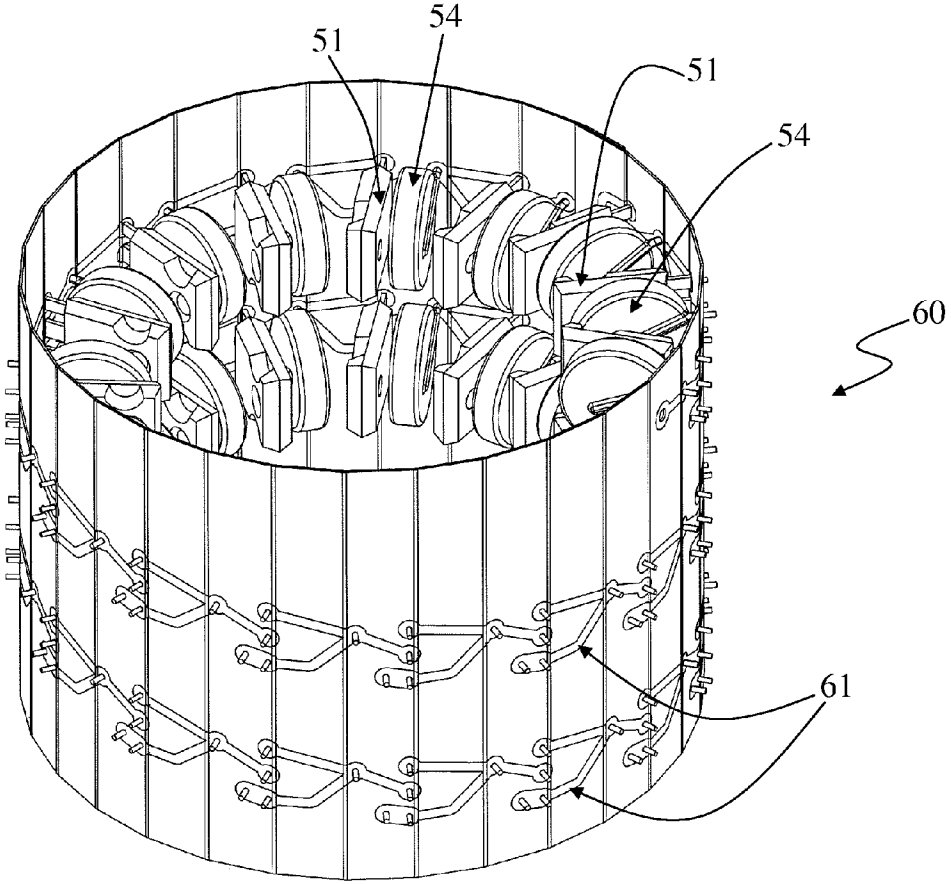
FIG. 9 shows the printed circuit board in FIG. 8 in accordance with an exemplary embodiment.
Figure 10:
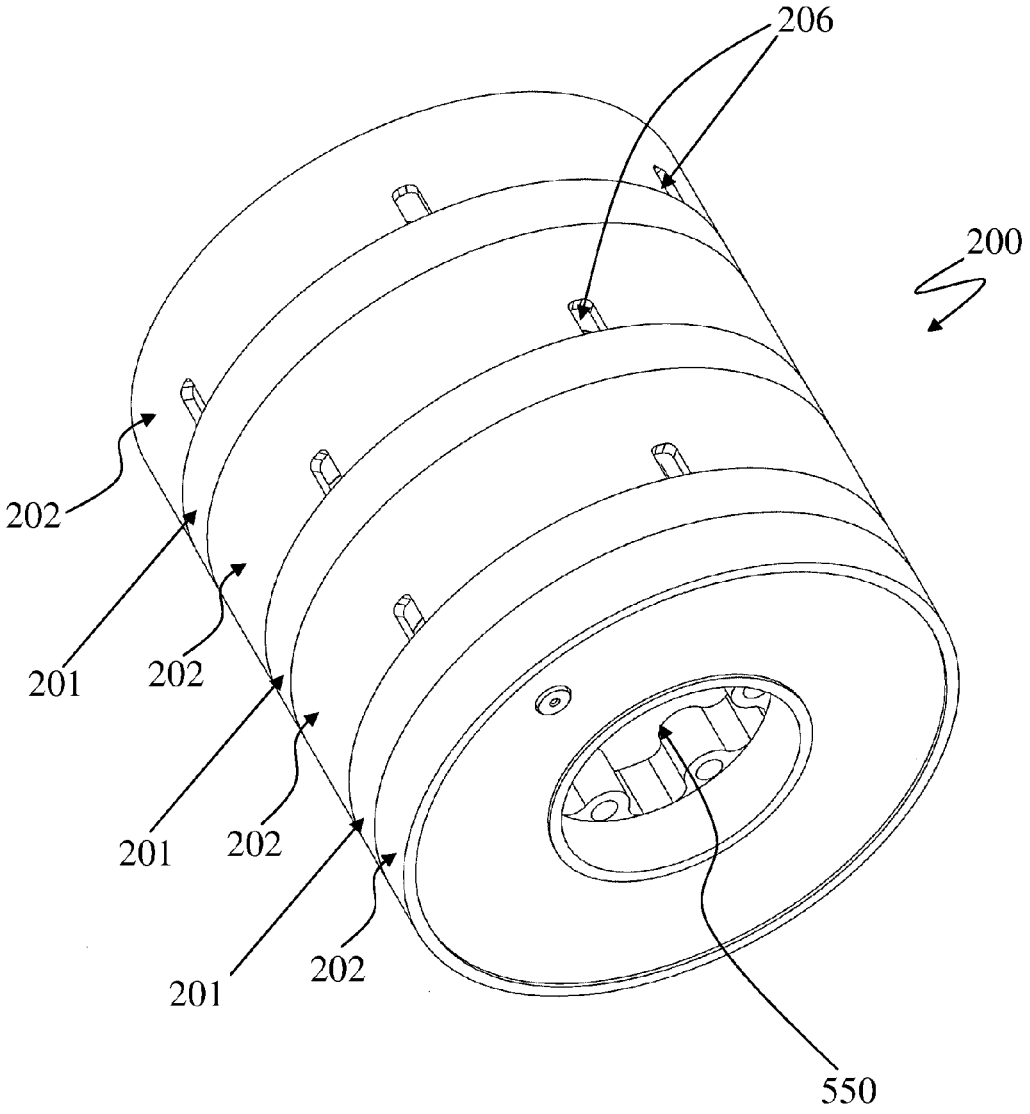
FIGS. 10 and 11 are a perspective view and an exploded view, respectively, of a second semiconducting assembly in accordance with an exemplary embodiment.

Each phase 2 includes an electrically semiconducting assembly (or electric assembly), such as the assembly 50 according to exemplary embodiments shown in FIGS. 1-6, or electric assemblies according to alternative embodiments, such as for example the assembly 200 shown in FIGS. 9-10. The electric assembly has an electrically insulating support operatively associated with a plurality of semiconductor devices 51 electrically connected in series to each other. The semiconductor devices 51 are devices suitable for blocking current flowing therethrough in a blocking direction and for conducting current flowing therethrough in an allowed direction. Non limiting examples of such semiconductor devices 51 are diodes or thyristors.

The semiconductor devices 51 are associated and electrically connected to the fixed contact 5 and the movable contact 4 through first connection means and second connection means of the electric assembly, respectively. In particular, the overall semiconductor devices 51 are able to provide a conductive path for the current flowing through the phase 2; such conductive path is electrically connected in parallel with the main conductive path provided by the coupled fixed and movable contacts 5, 4.

Each phase 2 includes a housing 3 for the fixed contact 5 and the movable contact 4, preferably an electrically insulating housing 3 (made for example of epoxy resin) defining a sealed environment filled with electrically insulating gas, such as for example $SF_6$ or $CO_2$ or $N_2$; alternatively, the sealed environment defined by the housing 3 may be a vacuum environment.

The housing 3 is for example a standard housing for the movable contact and the fixed contact of a medium voltage circuit breaker of known type, such as for example the pole casing of a medium voltage circuit breaker HD4 produced by ABB®.

The electric assembly is configured to be installed into the housing 3 so as to surround at least a portion of at least one of the fixed contact 5 and the movable contact 4 when it is coupled to the fixed contact 5. For example, FIGS. 2-4 illustrate the internal part of a housing 3 with an assembly 50 installed therein.

FIGS. 2-4 are sectional views showing the inner part of a housing of the switching device in FIG. 1, each at a different position of the movable contact in accordance with an exemplary embodiment. As shown in FIGS. 2-4, the movable contact 4 can bea piston 4 (or rod 4) actuated by driving means 8 (including for example an electric motor associated with a transmission mechanism) so as to move into the housing 3 along an axial direction (X-axis). The fixed contact 5 can be configured for example as a socket element 5 (or hollow rod 5), suitable for receiving therein a portion of the piston 4. The movable contact 4 and the fixed contact 5 can have any other suitable shape or configuration.

The movable contact 4 is able to assume at least:

a first position, wherein it is mechanically coupled to the fixed contact 5 (for example, in FIG. 4 it is inserted into the fixed contact 5);

a second position, wherein it is spatially separated from the fixed contact 5 (for example, in FIGS. 2-3 it is out from the corresponding hollow portion of the fixed contact 5) and electrically connected to the second connection means of the electric assembly (see FIG. 3);

a third position, wherein it is spatially separated from the fixed contact 5 and electrically disconnected from the second connection means of the electric assembly (see FIG. 2).

The movement of the contact 4 among these three positions is synchronized with the waveform of the alternate current flowing through the phase 2, as it will be become more apparent from the following description.

An exemplary electric assembly according to the present disclosure is configured for surrounding at least the fixed contact 5. In particular, the electric assembly can include a fixed contact 5 mounted therein.

The electric assembly is configured for allowing the passage therethrough of the movable contact 4 for coupling/separating to/from the fixed contact 5. In particular, the electric assembly includes a hole, such as the hole 55 of the illustrated assembly 50, or the hole 550 of the illustrated assembly 200, which is suitable for receiving the fixed contact 5, and extending along the axis X for allowing the passage therethrough of the movable contact 4 in order to couple/separate to/from the fixed contact 5.

The second connection means of the electric assembly can be placed at the entry of the hole for the passage of the movable contact 4, and are configured to operatively contact the movable contact 4 during a portion of its movement. For example, the movable contact 4 slides onto the second connection means.

According to an exemplary embodiment, the electric assembly includes a foldable printed circuit board 60 with conducting strips 61, made for example of copper, on which the plurality of semiconductor devices 51 is mounted, for example, soldered.

Figure 5:
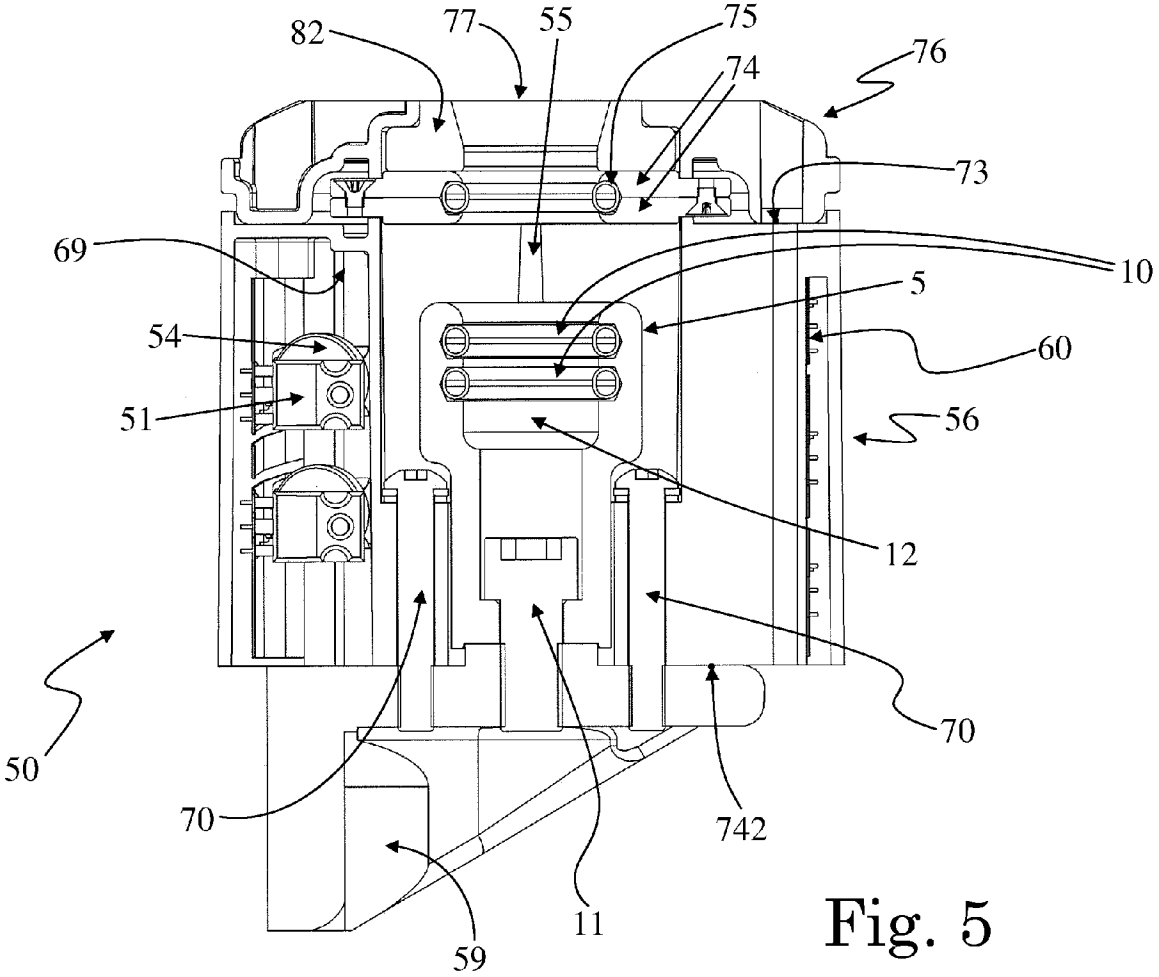
FIG. 5 is a cross (or section) view of a first semiconducting assembly, in accordance with an exemplary embodiment.
Figure 6:
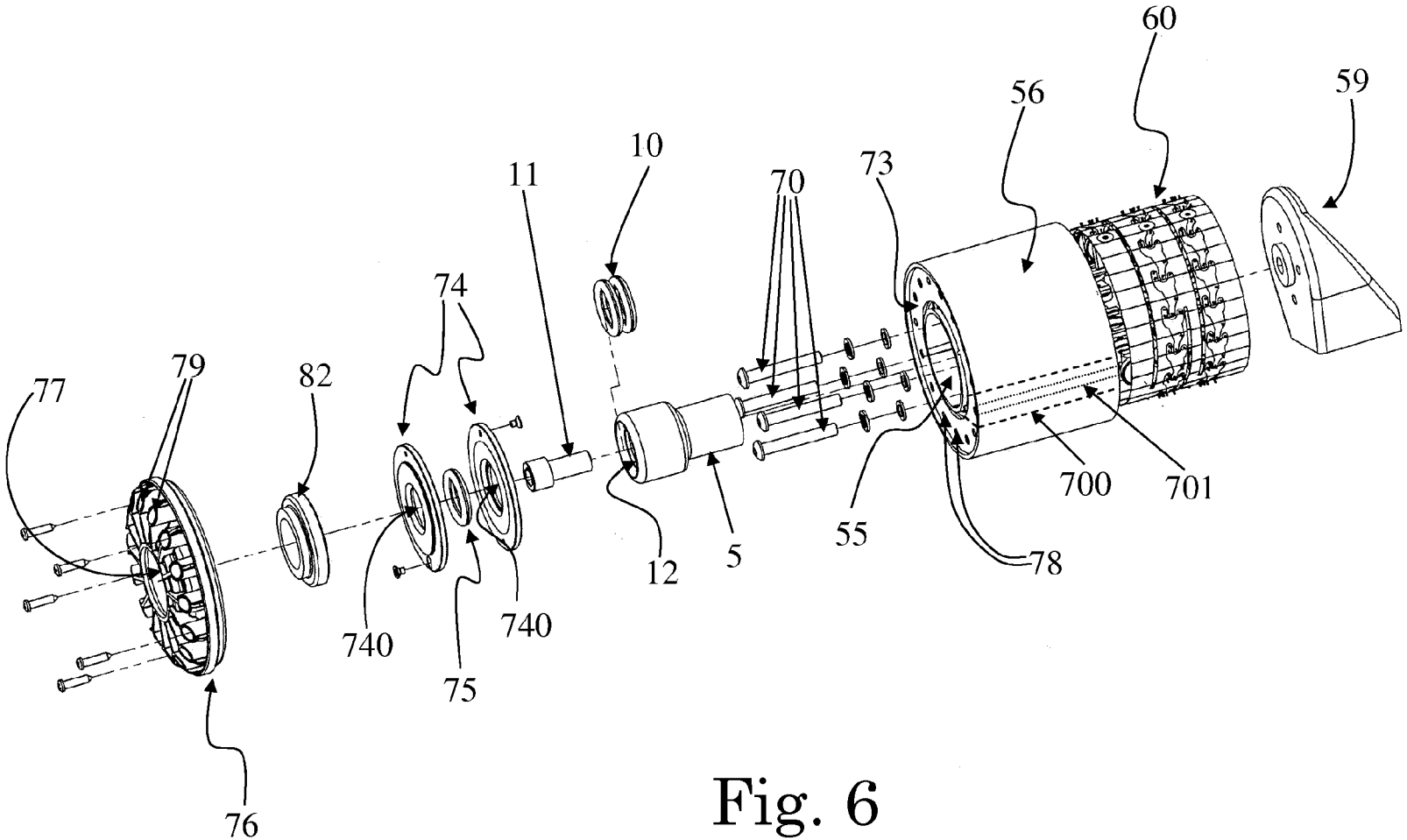
FIG. 6 is an exploded view of the first semiconducting assembly in accordance with an exemplary embodiment.

FIG. 5 is a cross (or section) view of a first semiconducting assembly, in accordance with an exemplary embodiment. FIG. 6 is an exploded view of the first semiconducting assembly in accordance with an exemplary embodiment. The printed circuit board 60 of the assembly 50 shown in FIGS. 1-6 can be rolled by coupling its opposite ends 62, 63 delimiting its longitudinal extension, to feature a substantially cylindrical shape. The conducting strips 61 can be designed to realize, upon the printed circuit board 60 is rolled, a spiral path for mounting the plurality of semiconductor devices 51 such as the rolled printed circuit board 60 in FIG. 9.

Figure 7:
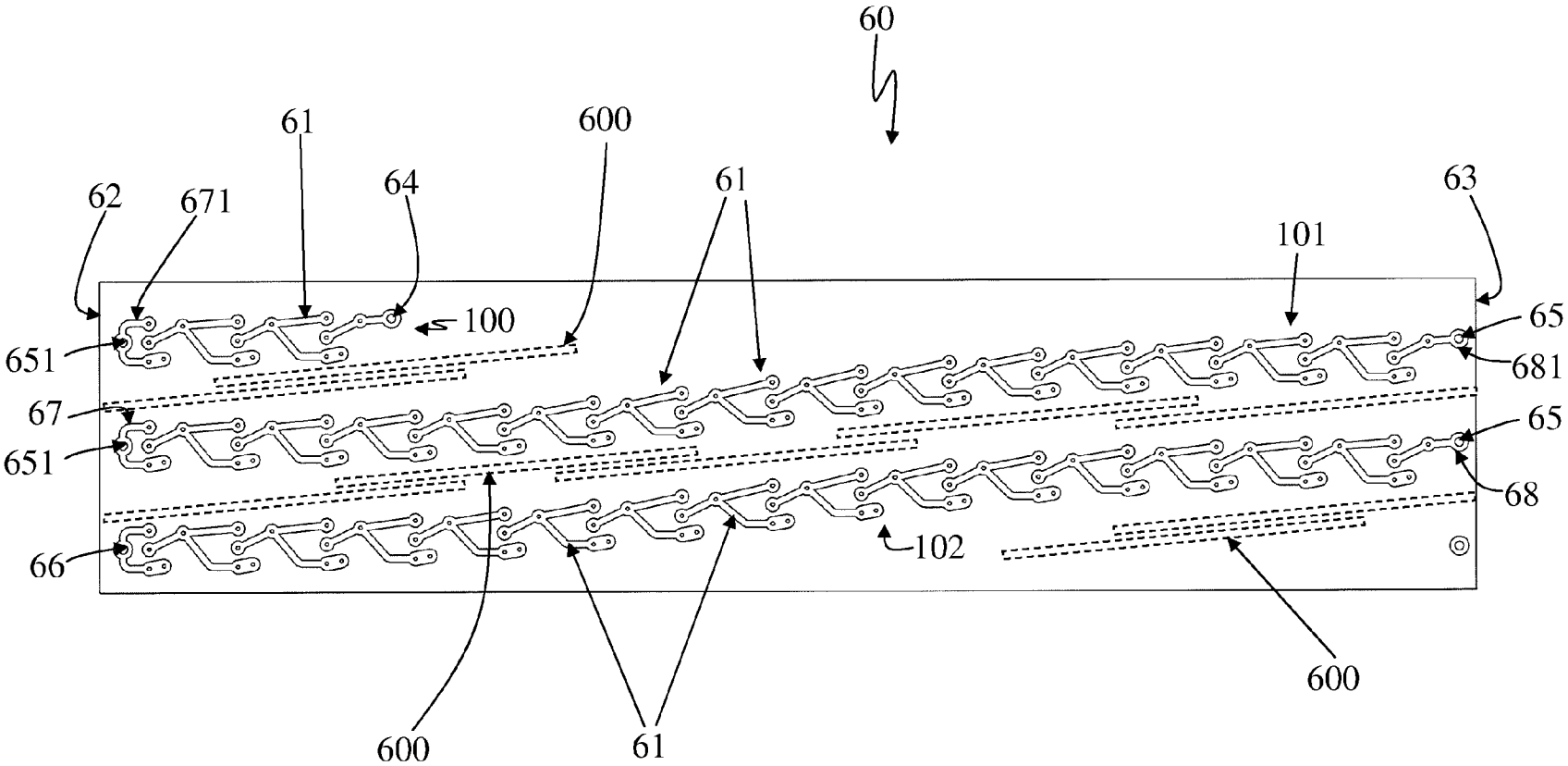
FIG. 7 is a plan view of a printed circuit board used in the first semiconducting assembly in accordance with an exemplary embodiment.

FIG. 7 is a plan view of a printed circuit board used in the first semiconducting assembly in accordance with an exemplary embodiment. FIG. 7 is a plan view of the unrolled printed circuit board 60, with its conducting strips 61 arranged along three parallel rows 100, 101, 102 extending between the opposite ends 62, 63 of the printed circuit board 60. Rows 100, 101, 102 are defined so as, upon the printed circuit board 60 is rolled, the ends 68, 681 of the rows 102, 101 placed at the second end 63 of the printed circuit board 60 contact the corresponding ends 67, 671 of the rows 101, 100 which are placed at the opposite first end 62 of the printed circuit board 60.

In particular, holes 65 are defined at the ends 68, 681 and are suitable to match, upon the printed circuit board 60 is rolled, with corresponding holes 651 defined at ends 67, 671. Securing means, such as conductive pins non visible in the illustrated examples, are inserted through match holes 65-67 so as to block the printed circuit board 60 in the rolled configuration.

Further, as shown in FIG. 7, a hole 64 in row 100 and a hole 66 in row 102 delimit, upon the printed circuit board that is rolled, the spiral path for mounting the plurality of semiconductor devices 51. Therefore, the hole 64 and the hole 66 constitute input/output points for the current flowing through the overall semiconductor devices 51.

Advantageously, cuts 600, which are shown in dashed lines in FIG. 7 may be defined on the printed circuit board 60 at least between the rows 100-102, so as to increment the electrical insulation between the turns of the spiral path.

Figure 8:
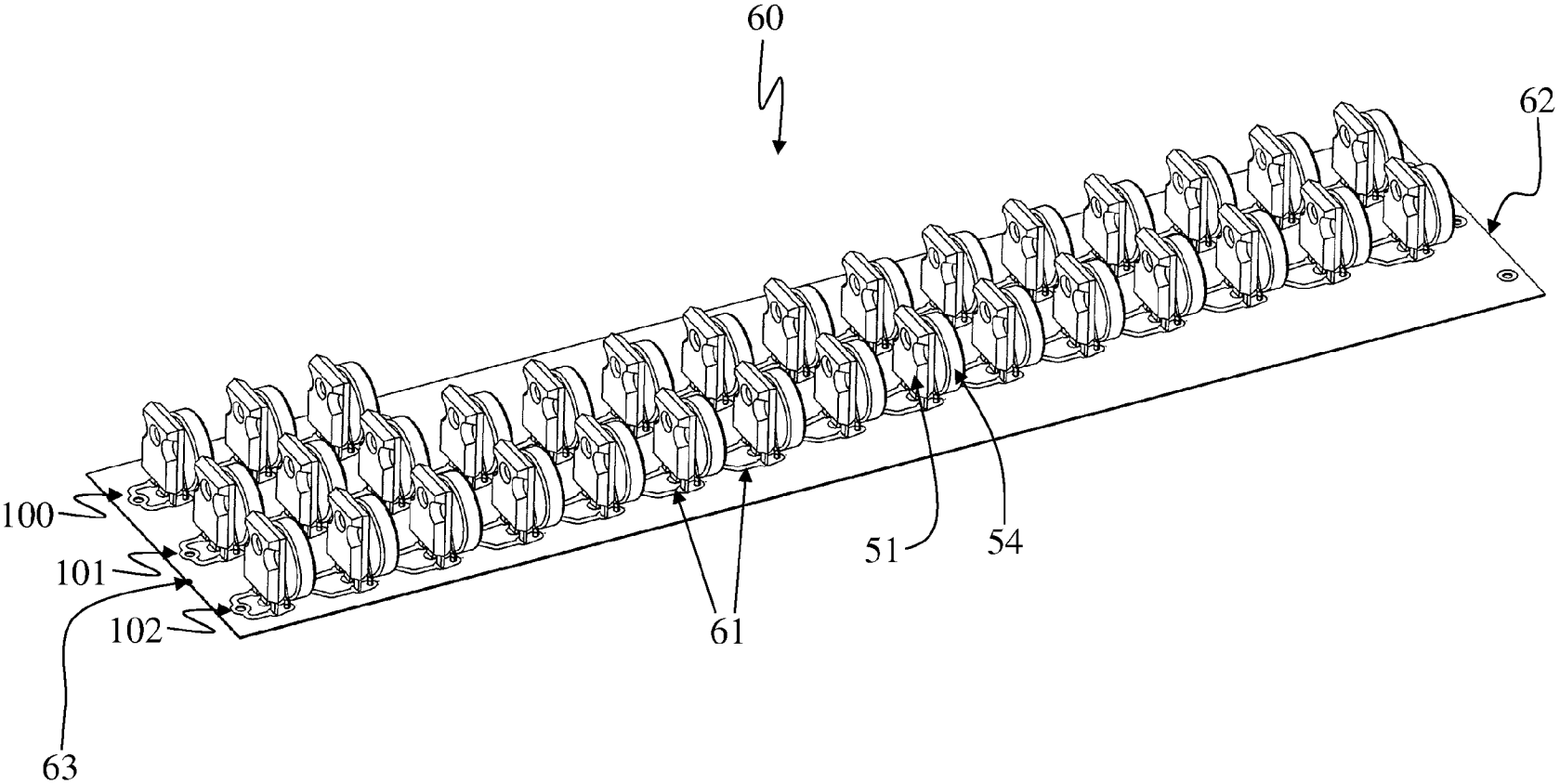
FIG. 8 is a perspective view of the printed circuit board in FIG. 7, in accordance with an exemplary embodiment.

FIG. 8 is a perspective view of the printed circuit board in FIG. 7, in accordance with an exemplary embodiment. FIG. 8 shows the unrolled printed circuit board 60 of FIG. 7, with diodes 51 mounted on the conducting strips 61. The series of diodes 51 withstands the operating voltage of the switching device 1, and the number of diodes 51 is such that each diode 51 withstands an operating voltage less than a maximum nominal voltage about 1.6 kV AC, for example, for package diodes, such as the diodes 51 shown in FIG. 8. In exemplary illustrated embodiment as illustrated in FIG. 8, thirty-three standard package diodes 51 can be mounted on the printed circuit board 60, each one withstanding, during its operation, a voltage of about 1 kV AC, for example, for applications of the switching device 1 with nominal voltages of about 38 kV AC.

The number of rows 100, 101, 102 and/or the number of diodes 51 mounted thereon may be different from the ones as illustrated. For example, the number of diodes 51 shown in FIG. 8 can be reduced for the switching device 1 operating in lower voltages applications, simply by removing a predefined group of diodes 51 from the corresponding conducting strips 61.

The switching device 1 may include detecting means for monitoring the integrity of diodes 51 and outputting an alarm signal in case of fault conditions.

According to an exemplary embodiment, semiconductor devices 54, operating as voltage limiting devices 54, are also mounted on the conductive strips 61 of the printed circuit board 60, so as to be electrically in parallel with diodes 51. To this end, as shown in the exemplary embodiment of FIG. 8, varistors 54, such as for example Zn oxide varistors 54, are used.

As shown in the exemplary embodiment of FIGS. 5 and 6, the insulating support of the assembly 50 includes an electrically insulating box 56, for example, made of plastics which have a substantially cylindrical shape housing the rolled printed circuit board 60 shown in FIG. 9. FIG. 9 shows the printed circuit board in FIG. 8 in accordance with an exemplary embodiment. A hole 55 for the passage of the movable contact 4 is defined centrally and along the overall longitudinal extension of the insulating box 56, namely from an upper edge 73 to a lower edge 742 of the insulating box 56.

The rolled printed circuit board 60 is placed into a seat 69 which is radially defined into the insulating box 56 around the hole 55, and which extends longitudinally between the upper edge 73 and the lower edge 742 of the insulating box 56 (see e.g., FIG. 5).

The seat 69, with the rolled printed circuit board 60 inserted therein, can be filled with insulating material, such as resin, to improve the electrical insulation between the turns of the spiral path supporting the diodes 51, and to increase the stability of the structure constituted by printed circuit board 60 and the semiconductor devices 51 (and 54, if present) mounted thereon.

The second connection means of the assembly 50 can be coupled, to the superior edge 73 so as to be placed at the entry of the hole 55 for the passage of the movable contact 4. In particular, the second connection means covers the entry of the hole 55, and are therefore configured for being penetrated by the movable contact 4 entering in or coming out from the hole 55. In particular, as shown in the exemplary embodiment in FIGS. 5 and 6, the second connection means includes at least two conducting plates 74 with through holes 740, and a contact ring 75 between the two plates 74.

The plates 74 are electrically connected to the plurality of diodes 51 mounted on the rolled printed circuit board 60 in the seat 69, and the contact ring 75 contacts the sliding surface of the movable contact 4 passing through the holes 740 of the discs 74. In particular, the contact ring 75 is suitable for contacting the movable contact 4 with reduced friction.

The illustrated assembly 50 further includes a cover 76 made of insulating material (for example plastics) which is coupled, (e.g., fastened), to the upper edge 73 of the insulating box 56, so as to cover the plates 74 and the contact ring 75. The cover 76 has an inlet 77 for the passage of the movable contact 4 therethrough. A ring element 82 can be coupled to the edges of the inlet 77 for guiding the passage of the movable contact 4 toward/from the contact ring 75 (see FIGS. 5 and 6).

The assembly 50 includes a mounting base 59 made of electrically conducting material (for example aluminum) which is suitable for being connected to the first terminal 6 of phase 2, upon the installation of the assembly 50 into the housing 3.

The fixed contact 5 has a hollow portion 12 for receiving a respective portion of the movable contact 4 (constituted by the piston 4 in the exemplary embodiment shown in FIGS. 2-4), and includes contact rings 10 at the inlet of its hollow portion 12. Contact rings 10 are suitable for improving the contact between the fixed contact 5 and the sliding piston 4. The fixed contact 5 is secured to the mounting base 59 through a screw 11.

The insulating box 56 is mounted on the mounting base 59 in such a way that the fixed contact 5 is inserted into the hole 55. In particular, as shown in FIGS. 5 and 6 the insulating box 56 is secured to the mounting base 59 through a plurality of screws 70.

The first connection means of the assembly 50 includes at least one of the screws 70 which is electrically connected to the overall semiconductor diodes 51 of the printed circuit board 60, and the mounting base 59 connected to the fixed contact 5 and to the terminal 6 of the phase 2.

The assembly 50 can be configured for allowing the passage therethrough electrically insulating the gas used for filling the housing 3 (after the assembly 50 has been inserted into the housing 3). In particular, the assembly 50 includes partitions into the seat 69 (one of which is schematically represented by dashed lines in FIG. 6 and indicated by numeral reference 700), extending radially with respect to the hole 55, between the upper edge 73 and the lower edge 742 of the insulating box 56.

At least a vent channel 701, such as the vent channel 701 represented schematically in FIG. 6 by dashed lines, passes through one or more of the partitions 700. The assembly 50 is configured so that said at least one vent channel 701 is accessible externally from the assembly 50. In particular, each vent channel 701 is accessible at a first end by through-openings 78 which are defined on the edge 73 and through-openings 79 which are defined on the cover 76. The second end of the vent channels can be which are connected to means for injecting the electrically insulating gas into the housing 3, for example during manufacturing of the switching device 1.

An example of the operation of the exemplary switching device 1 according to the present disclosure is now disclosed, by making reference to a switching device 1 with the assembly 50 installed into the housings 3 of its phase 2, as illustrated in FIGS. 2-4, without in any way precluding the principles of such an operation to switching devices 1 using other alternative embodiments of the electric assembly according to the present disclosure, such as the assembly 200 illustrated in FIGS. 9-10.

Starting from the situation illustrated in FIG. 4 (corresponding to the closed switching device 1), the movable contact 4 is inserted in the corresponding hollow portion 12 of the fixed contact 5, which in turn is inserted into the hole 55 of the assembly 50. In normal operating conditions, the coupling between the movable contact 4 and the fixed contact 5 realizes the main conducting path for the current flowing through the phase 2, between the first and second terminals 6, 7. In this situation, the conducting path provided by the overall diodes 51 is short-circuited by the main conducting path provided by the coupled movable contact 4 and fixed contact 5.

When an opening operation of the switching device 1 is specified, for example due to a fault or for disconnecting a capacitor bank from the power line associated to the switching device 1, the movable contact 4 is actuated by the driving means 8 so as to spatially separate from the fixed contact 5 for example, as shown in the exemplary embodiment shown in FIGS. 2-3, the spatial separation occurs when the movable contact 4 exits the corresponding hollow portion 12 of the fixed contact 5.

Figure 12:
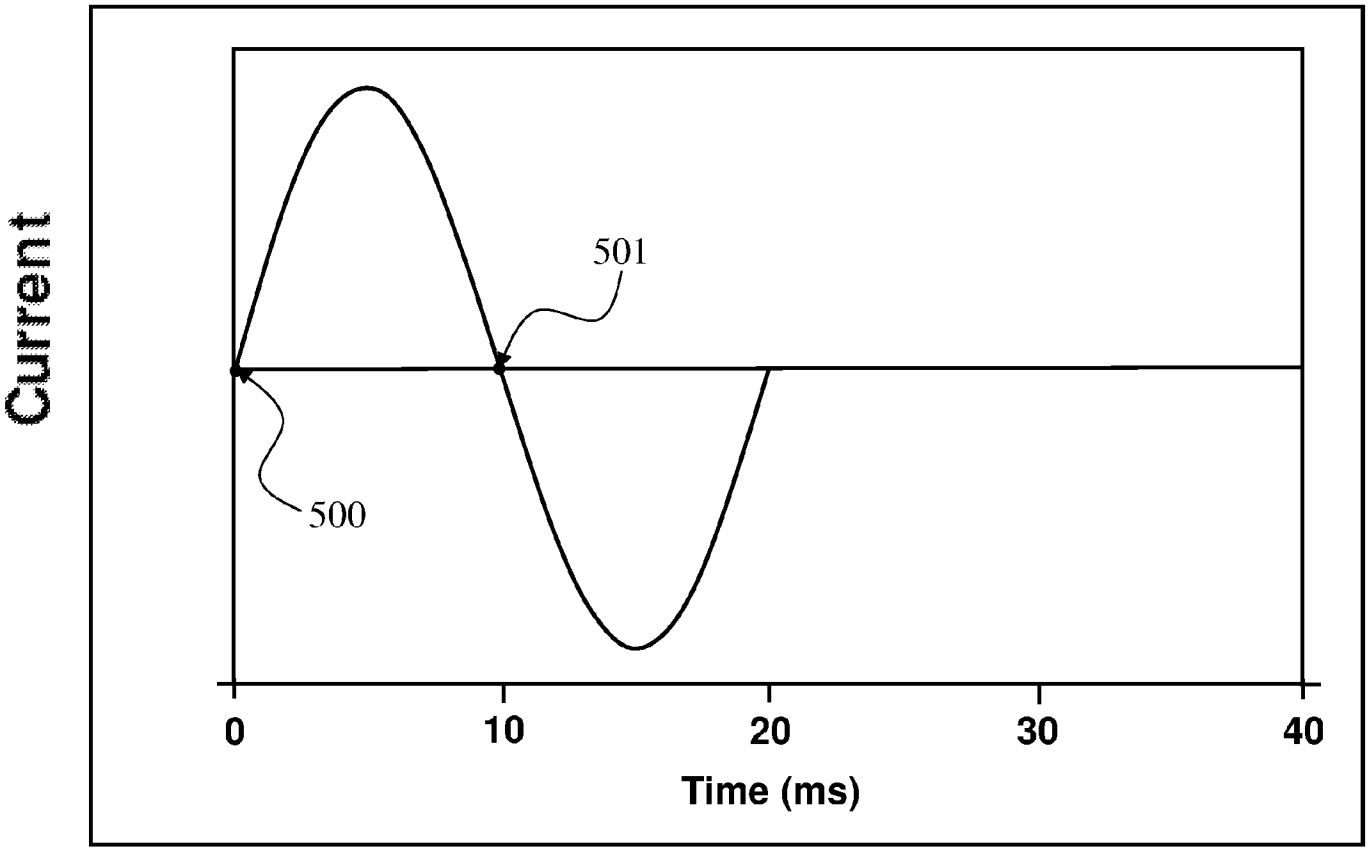
FIG. 12 shows a period of an alternate current flowing through a phase of a switching device in accordance with an exemplary embodiment.

FIG. 12 shows a period of an alternate current flowing through a phase of a switching device in accordance with an exemplary embodiment. The movement of contact 4 along the illustrated axis X is calibrated so as said spatial separation starts at a first zero-crossing point 500 of the alternate current waveform flowing through phase 2, or a short time (e.g. one or two ms) later with respect to said first zero-crossing point 500. Immediately after the first zero-crossing point 500, the current direction allows the conduction by the overall diodes 51 of such current.

Therefore, at the spatial separation between the fixed and movable contacts 5, 4, the current flowing through the phase 2 starts flowing through the conducting path provided by the overall diodes 51. In this way the generation of electrical arcs between the fixed contact 5 and the movable contact 4 is avoided or at least substantially reduced.

After the spatial separation from the fixed contact 5, the movable contact 4 continues its movement along axis X, slides onto the contact ring 75 placed at the entry of the hole 55, and arrives at the position shown in FIG. 3. In such a position, the end of the movable contact 4 is still mechanically in contact with the contact ring 75. Therefore, during the sliding from its position shown in FIG. 4 to its position shown in FIG. 3, the movable contact 4 is electrically connected to the overall diodes 51 through the contact ring 75 and the conducting plates 74, so as to allow the current to flow through the phase 2.

Then, the movable contact 4 continues to slide along the axis X, and spatially separates from the contact ring 75, until it reaches its final position shown in FIG. 2, wherein the opening operation of the switching device 1 is concluded.

The movement of the contact 4 is calibrated so as the spatial separation between the end of the movable contact 4 and the contact ring 75 occurs at a second zero-crossing point 501 of the alternate current waveform, or a short time (e.g. one or two ms) later with respect to said second zero-crossing point 501. As shown in FIG. 12, the second zero-crossing point 501 is consecutive in time to the first zero-crossing point 500; immediately after the second zero-crossing point 501, the current direction blocks the conduction by the overall diodes 51 of such a current.

In this way, the generation of electrical arcs between the second connection means 74, 75 of the assembly 50 and the movable contact 4 separating from them is avoided or at least substantially reduced.

The closing operation of the switching devices 1 is the reverse process, starting from the situation shown in FIG. 2, wherein no current can flow though phase 2.

When the closing of the switching device 1 is specified, the driving means 8 cause the sliding of the movable contact 4 along the axis X, toward the fixed contact 5. The movement of the contact 4 is calibrated so as the end of the movable contact 4 starts mechanically contacting the contact ring 75 (see FIG. 3) a short time (e.g. one or two ms) before said first zero-crossing point 500. In this way, the generation of electrical arcs between the movable contact 4 and the contact ring 75 is avoided or at least substantially reduced.

Immediately after the first zero-crossing point 500, current starts flowing thorough the overall diodes 51 which act limiting the inrush current and transient voltages generated between the phase line and the electrical load associated to the phase 2.

In particular, the inrush current and the transient voltages are generated when the electrical load associated to the switching device 1 is a bank of capacitors for adding/removing reactive power to/from the power line associated to the switching device 1, according to a first exemplary application of such a switching device 1.

Then, the movable contact 4 penetrates into the hole 55 of the insulating box 56, until entering into the corresponding hollow portion 12 of the fixed contact 5 (see FIG. 4). The movement of the movable contact 4 is calibrated so as the mechanical contact with the fixed contact 5 starts a short time (e.g. one or two ms) before the second zero-crossing point 501 of the current waveform. In this way no electrical arcs are generated between the movable contact 4 and the fixed contact 5, because the current is flowing through the overall diodes 51.

The conductive path provided by the overall diodes 51 is short-circuited by the re-established main conductive path provided by the coupling of the movable contact 4 with the fixed contact 5.

The disclosed opening and closing operations could be performed in a second exemplary application of the switching device 1 conceived as a hybrid circuit breaker for breaking currents due to electrical faults. In this case, high current diodes have to be provided in the assembly 50.

According to an alternative exemplary embodiment, include the insulating support of the assembly in the switching devices 1 may include a block of insulating material, for example a casted resin, into which are embedded at least the semiconductor devices 51 (such as diodes 51) with the electrical connections for electrically connecting in series such semiconductor devices 51 to each other. The insulating block may embed also varistors 54 connected electrically in parallel with semiconductor devices 51.

The insulating block is suitable for being installed into a respective housing 3 of a phase 2 of the switching device 1, to completely surround the fixed contact 5. For example, the insulating block has a substantially cylindrical shape with a central hole defined along its longitudinal extension the central hole is suitable for receiving the mobile contact 4 for coupling/separating to/from the fixed contact 5 which is inserted into the central hole.

If the insulating block is cast as a monolithic block, the semiconductor devices 51 can be embedded into the insulating block of the electric assembly so as to be arranged into the housing 3 along a spiral path extending around the central hole of the insulating block itself.

According to another exemplary embodiment, the electric assembly of the switching device 1 according to the present disclosure may have a modular structure, wherein the insulating support for the semiconductor devices 51 of such assembly comprises at least a first modular member and a second modular member mutually coupled. The first modular member and the second modular member support a first group and a second group of semiconductor devices 51, respectively, wherein connection means are interposed between the first modular member and the second modular member for electrically connecting in series one to the other of the first group and the second group of semiconductor devices 51.

For example, the above mentioned insulating block may be realized as a stack of resin disc portions, each having at least a group of semiconductor devices 51 embedded therein, wherein electrical connection means are provided between adjacent disc portions.

Figure 11:
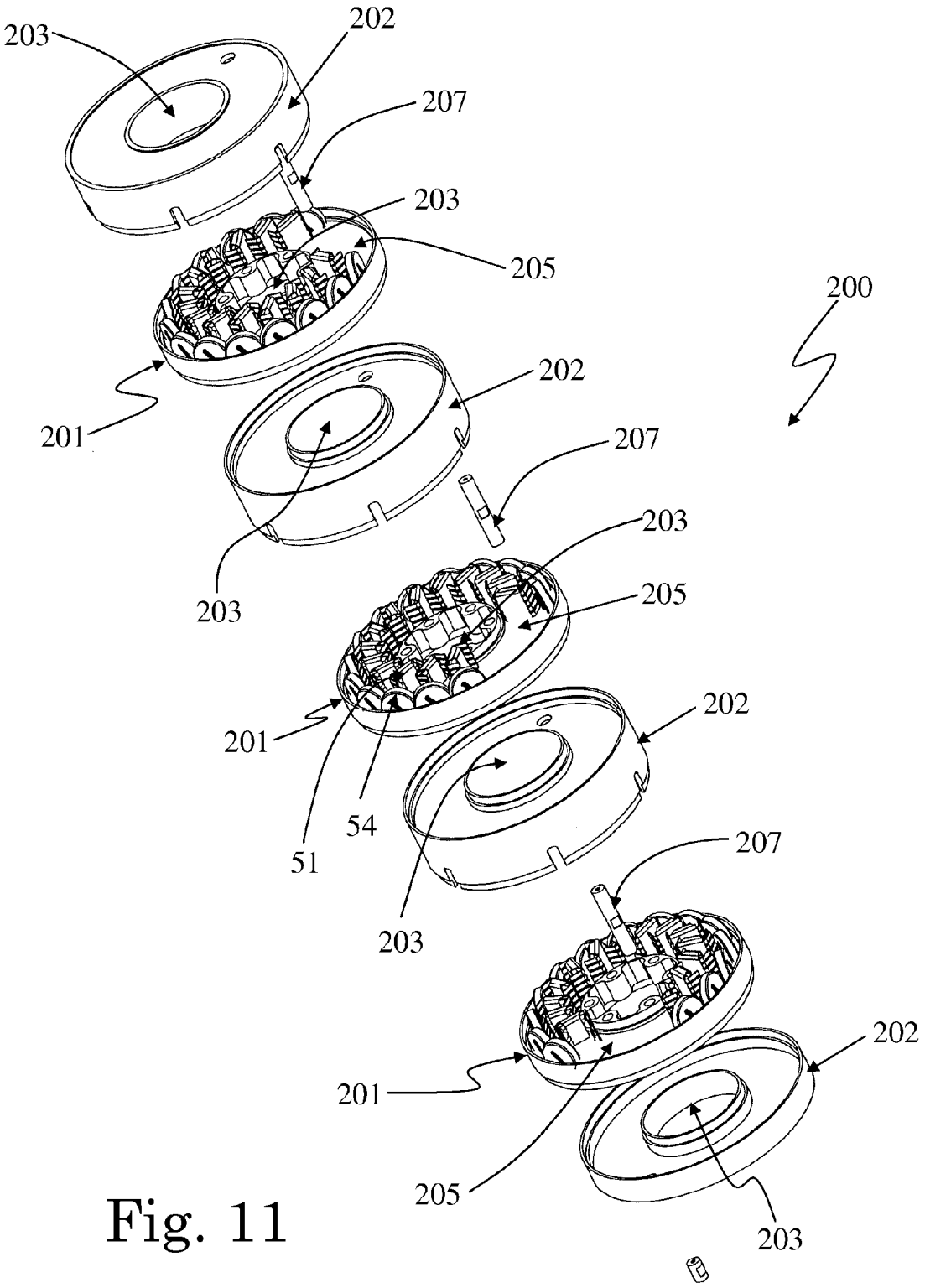

As shown in the alternative exemplary embodiment shown in FIGS. 10-11, the assembly 200 is realized as a stack composed by coupling in an alternating way mounting discs 201 (each made of insulating material, such as plastics, and supporting a group of semiconductor devices 51 and, if desired, the respective varistors 54), and covering discs 202 (made of insulating material, such as plastics, and suitable for covering the frontal and rear sides of each mounting disc 201).

The assembled stack 200 is suitable for being installed into each housing 3 of the phases 2 of the switching device 1, to completely surround the fixed contact 5; as shown in the exemplary embodiment of FIG. 11, mounting and covering discs 201, 202 have central holes 203 mutually matching at the coupling of mounting and covering discs 201, 202, so as to form the central hole 550 along the longitudinal extension of the assembly 200.

The central hole 550 is suitable for receiving the mobile contact 4 for coupling/separating to/from the fixed contact 5, which is inserted into the hole 550.

Each mounting disc 201 includes a seat 205 defined around its hole 203, inside which is placed a printed circuit board with the semiconductor devices 51 (and varistors 54, if present) mounted thereon. Connections means, such as conductive pins 207, pass through the covering discs 202 so as to electrically connect in series one to other the groups of semiconductor devices 51 placed on different mounting discs 201, and so as to provide connection means for the assembly 200 and other parts of the switching device 1.

Openings 206 are defined in covering discs 202 for the passage therethrough of the gas filling the housing 3.

The modular structure of the electric assembly, according to the two disclosed exemplary embodiments, guaranties a particular versatility of the switching device 1, since one or more modular members, such as the disc portions of the insulating block, or the mounting discs 201 of the assembly 200, can be added or removed according to the nominal voltages of the specific application of the switching device 1.

In practice, it has been seen how the switching device 1 according to the present disclosure allows offering some improvements over known solutions.

In particular, the electric assembly according to the present disclosure (such as the illustrate assembly 50 or the illustrated assembly 200) allows the insertion of a large number of semiconductor devices 51 (and varistors 54, if present) into the limited volume provided by the housing 3 of the phase 2, keeping a proper distance and insulation between the semiconductor devices 51, and guaranteeing a uniform distribution, across each semiconductor device 51, of the overall voltage applied across the overall series of semiconductor devices 51. Particularly suitable for these purposes is the arrangement of semiconductor devices 51 along a spiral path, as in the assembly 50 with the rolled printed circuit board 60.

Further, the electrical assembly 50, 200 of the switching device 1 according to the present disclosure is configured to be inserted into a standard pole casing 3 for the movable and fixed contacts of a medium voltage circuit breaker of known type. Therefore, dimensions and electrical power connections of the switching device 1 are those of a standard medium voltage circuit breaker; in this way, the switching device 1 is easily installable in standard cabinets for the medium voltage power distribution.

Moreover, all parts/components can be replaced with other technically equivalent elements; in practice, the type of materials, and the dimensions, can be any according to needs and to the state of the art. For example, instead of using standard package diodes 51, different types of diodes can be used, such as for example crimp or screw fixing diodes mounted on suitable supports provided in the electric assembly of the switching device 1; the electric assembly can be realized in a different number of parts, and/or the parts can be differently shaped, and/or differently positioned, and/or differently coupled. It is also possible to perform any combination of the previous embodiments.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claim is:

1. A switching device for connecting and disconnecting a power line to and from, respectively, at least an associated electrical load, comprising:

at least one phase of the switching device having a housing that includes a movable contact configured to be coupled to and separated from a corresponding fixed contact, wherein the at least one phase of the switching device comprises:

an electrically semiconducting assembly having an insulating support operatively associated with a plurality of semiconductor devices, wherein said plurality of semiconductor devices are connected in series and are electrically connected to said fixed contact and to said movable contact during a portion of the movement of said movable contact, and wherein said semiconducting assembly is configured to be installed into said housing to surround at least a portion of at least one of said fixed contact and said movable contact when it is coupled to the fixed contact, wherein said semiconducting assembly comprises first connection means electrically connecting said plurality of semiconductor devices to the fixed contact, and second connection means for electrically connecting said plurality of semiconductor devices to the movable contact, wherein said movable contact is movable to:

a first position, where it is coupled to the fixed contact;

a second position, where it is spatially separated from the fixed contact and electrically connected to the second connection means; and a third position, where it is spatially separated from the fixed contact and electrically disconnected from the second connection means, and wherein said movable contact moves along an axial direction to said first, second and third positions, and said semiconducting assembly comprises:

a hole suitable for receiving the fixed contact and extending along said axial direction (X) to allow passage therethrough of the movable contact to couple to and separate from the fixed contact.

2. The switching device according to claim 1, wherein said semiconducting assembly is configured such that said plurality of semiconductor devices are arranged in said housing along a spiral path.

3. The switching device according to claim 1, wherein said semiconducting assembly is configured to surround the fixed contact and to allow passage therethrough of the movable contact for coupling to and separating from the fixed contact.

4. The switching device according to claim 3, wherein said semiconducting assembly comprises said fixed contact mounted therein.

5. The switching device according to claim 1, wherein said second connection means of the semiconducting assembly are placed at the entry of the hole for passage of the movable contact, and are configured to operatively contact the movable contact.

6. The switching device according to claim 5, wherein said semiconducting assembly is configured to allow passage therethrough of electrically insulating gas.

7. The switching device according to claim 1, wherein said semiconducting assembly is configured to allow passage therethrough of electrically insulating gas.

8. The switching device according to claim 1, wherein said semiconducting assembly comprises a printed circuit board with conducting strips on which said plurality of semiconductor devices is mounted, wherein said printed circuit board is rolled.

9. The switching device according to claim 8, wherein said printed circuit board is rolled by coupling its first and second opposite ends, and wherein said conducting strips are designed to form a spiral path for mounting the plurality of semiconductor devices.

10. The switching device according to claim 9, wherein said conducting strips are arranged along parallel rows extending between said first and second opposite ends of the printed circuit board, wherein said rows are defined so that an end of a row placed at said second end of the printed circuit board is configured to contact a corresponding end of an adjacent row placed at said first end of the printed circuit board, upon the printed circuit board is rolled.

11. The switching device according to claim 10, wherein cuts are defined on said printed circuit board between said parallel rows.

12. The switching device according to claim 8, wherein said insulating support comprises an insulating box with a seat configured to house said rolled printed circuit board.

13. The switching device according to claim 12, wherein said insulating box comprises partitions extending through a longitudinal extension of the seat, wherein at least one vent channel passes through at least one of said partitions, said assembly being configured so that said at least one vent channel is accessible from the external of the semiconducting assembly.

14. The switching device according to claim 13, wherein said first connection means of the assembly comprise a mounting base onto which the insulating box is mounted and to which the fixed contact is secured, and fixing means for securing the insulating box to the mounting base.

15. The switching device according to claim 12, wherein said semiconducting assembly comprises an insulating cover which is operatively coupled to said insulating box to cover said second connection means and which is configured to allow passage therethrough of said movable contact.

16. The switching device according to claim 1, wherein said insulating support comprises at least a block of insulating material into which at least a group of said plurality of semiconductor devices is embedded.

17. The switching device according to claim 1, wherein said insulating support comprises at least a first modular member and a second modular member mutually coupled, said first modular member and said second modular member supporting a first group and a second group of said plurality of semiconductor devices, respectively, wherein connection means are interposed between said first and second modular members for electrically connecting in series said first and second groups of semiconductor devices.

18. A switchgear comprising:

at least one switching device according to claim 1.

* * * * *